United States Patent [19]

Ushakov et al.

[11] 4,242,841

[45] Jan. 6, 1981

[54] APPARATUS FOR PREPARING AND FEEDING AN ABRASIVE-CONTAINING SUSPENSION INTO THE ZONE OF ACTION OF WORK TOOLS OF POLISHING AND FINISHING LATHES

[76] Inventors: Vladimir F. Ushakov, ulitsa Starykh boloherrkov, 9, kv. 56; Alexandr I. Pergunov, Leninsky prospekt, 152, kv. 75; Albert V. Alexeev, ulitsa Ostuzheva, 1, kv. 6; Pavel N. Maslennikov, ulitsa 25 Yanvarya, 18, kv. 119; Vladimir I. Seljutin, ulitsa Ilicha, 61, kv. 77, all of Voronezh, U.S.S.R.

[21] Appl. No.: 62,405

[22] Filed: Jul. 30, 1979

[51] Int. Cl.[3] ..... B24B 57/00

[52] U.S. Cl. ..... 51/263; 366/159; 366/160

[58] Field of Search ..... 51/263, 264, 292; 222/145; 366/160, 162, 159; 138/26

[56] References Cited

U.S. PATENT DOCUMENTS 4,059,929 11/1977 Bishop ..... 51/263

*Primary Examiner*—Othell M. Simpson
*Assistant Examiner*—Roscoe V. Parker
*Attorney, Agent, or Firm*—Lackenbach, Lilling & Siegel

[57] ABSTRACT

An apparatus for preparing and feeding an abrasive-containing suspension into the zone of action of work tools of polishing and finishing lathes consisting of units series-connected by pipes and forming a closed circuit, comprising a unit for preparing a suspension from starting materials, a distributing unit with branch pipes for feeding the suspension to each work tool, a reservoir for collecting a waste suspension and a unit for cleaning the waste suspension. The distributing unit is formed with a pipe having a variable cross section along the length thereof. The branch pipes are located on the pipe at points of greater cross section.

2 Claims, 2 Drawing Figures

APPARATUS FOR PREPARING AND FEEDING AN ABRASIVE-CONTAINING SUSPENSION INTO THE ZONE OF ACTION OF WORK TOOLS OF POLISHING AND FINISHING LATHES

BACKGROUND OF THE INVENTION

1. Field of the Invention

The invention relates to process equipment employed for working brittle materials (semiconductors, glass, ceramics and others) with the aid of an abrasive material, and more particularly, to apparatus for preparing and feeding abrasive-containing suspensions into the zone of action of work tools of polishing and finishing lathes.

The invention can be used for polishing semiconductor slices.

2. Description of the Prior Art

Basic conditions for ensuring a uniform working of a surface through a polishing operation by means of a non-bound abrasive are such that a constant solid (abrasive materials particles)-to-liquid phase ratio in a suspension fed into the zone of action of polishing disks, a constant pH (acidity) of a solution and a constant consumption of the suspension in the zone of working must be maintained.

Deviations from a specified ratio between the solid and the liquid phases in the suspension lead, for example, in the event of an increase in the number of abrasive particles, to scratches on a surface being polished. A lesser suspension flow rate (lesser consumption) results in the impaired quality of the surface being polished, with scratches, and irregularities due to appear thereon.

There is known an apparatus for preparing and feeding by gravity an abrasive-containing suspension into the zone of action of work tools of polishing and finishing lathes.

This apparatus, relatively simple in design, comprises a storage reservoir for the suspension and a distributing unit. The rate of flow of the suspension in this apparatus is governed by the amount thereof contained in the storage reservoir, and to ensure a constant flow rate, it is necessary to maintain this amount constant throughout the working cycle, thus, if no automation means are available, it requires additional attending personnel.

There is also known an apparatus for preparing and feeding an abrasive-containing suspension into the zone of action of work tools of polishing and finishing lathes, wherein the flow rate of the suspension is maintained constant by means of pumps and valves provided in a suspension feeding mains (cf. U.S. Pat. No. 4,059,929, dated 1977). The known apparatus comprises a unit for preparing the suspension from starting components, consisting of two tanks adapted to contain a suspension concentrate and a solvent fed separately thereinto. Each of the tanks is connected to its distributing unit formed with a pipe of constant cross section and branch pipes for feeding the suspension through mixing heads to each work tool. Each distributing unit communicates with its individual tank by means of outlets. The apparatus also comprises a waste suspension collecting tank communicating with a unit for cleaning the waste suspension where the solid abrasive particles are settled to the bottom while the separated solvent is pumped into a corresponding tank of the unit for preparing the suspension for re-use. This system operates in the manner below.

The suspension concentrate and the solvent from respective tanks are fed by pumps to the distributing units having branch pipes for feeding the starting components into the mixing heads, where the suspension concentrate is mixed with the solvent.

The resultant suspension from the mixing heads is fed to the working zone. The solid-to-liquid phase ratio can be adjusted by an appropriate variation of the delivery of the pumps. The excess components from the distributing unit are returned to the starting tanks.

The above apparatus for preparing and feeding the suspension is capable of providing a stable supply of the suspension to one lathe only.

When two or more lathes are to be served, it becomes rather difficult to provide for the same solid-to-liquid ratio in a suspension fed to all lathes.

This can be explained by the fact that, as the suspension flows along the pipe of the distributing unit, a portion thereof is passed through branch pipes to the individual lathes, so that the flow rate of the suspension drops to a minimum at the last lathe. The risk is thus increased of the abrasive particles settling in the pipe near the last lathes and of the liquid phase of the suspension segregating to individual fractions by specific gravity.

These phenomena bring about a variation in the solid-to-liquid ratio in the suspension which is difficult to control. The probability of settling of the solid particles is particularly great at points of connection of the branch pipes having a smaller cross section than the pipe of the distributing unit. Vortical fluxes which tend to appear at these points of connection additionally slow down the flow of the suspension, this resulting in an uneven dispersion of the solid abrasive particles, accumulation of mud and choking or plugging up of the branch pipes.

SUMMARY OF THE INVENTION

It is therefore an object of the invention to ensure stable parameters of an abrasive-containing suspension, in particular, to maintain constant the solid-to-liquid ratio.

Another object of the invention is to maintain constant the flow rate of an abrasive-containing suspension.

The above and other objects are attained in an apparatus for preparing and feeding an abrasive-containing suspension to work tools of polishing and finishing lathes, comprising a unit for preparing the suspension from starting materials or components, communicating through an outlet with a distributing unit formed with a pipe having branch pipes for feeding the suspension to each work tool and connected by an outlet to an inlet of the unit for preparing the suspension, a reservoir intended for collecting a waste suspension and communicating with a unit for cleaning the waste suspension, is connected in turn to a second inlet of the unit for preparing the suspension. In accordance with to the invention, the pipe of the distributing unit is variable in cross section and pipe sections of greater cross section are provided at points of connection of the branch pipes.

A maximum and a minimum cross-sectional area of the pipe of the distributing unit are preferably selected so as to meet the following ratio: $F_{max}=3$ to $5\ F_{min}$, where $F_{max}$, $F_{min}$ are respectively the maximum and the minimum cross sectional areas of the pipe and said distributing unit.

The apparatus of the invention for preparing and feeding an abrasive-containing suspension into the zone of action of work tools of polishing and finishing lathes makes it possible to improve the supply of the suspension to the work tools from the distributing unit.

The distributing unit with a pipe of a variable cross sectional area permits the suspension composition to be uniform throughout the length of the pipe of the distributing unit. The provision of the alternatingly expanding and contracting sections of the pipe make it possible to eliminate the settling of solids therein, the formation of stagnant zones and the choking of the branch pipes.

BRIEF DESCRIPTION OF THE DRAWINGS

These and other objects and features of the invention become readily apparent from one embodiment thereof which will now be described by way of example with reference to the accompanying drawings, in which.

DESCRIPTION OF THE PREFERRED EMBODIMENT

Figure 1:
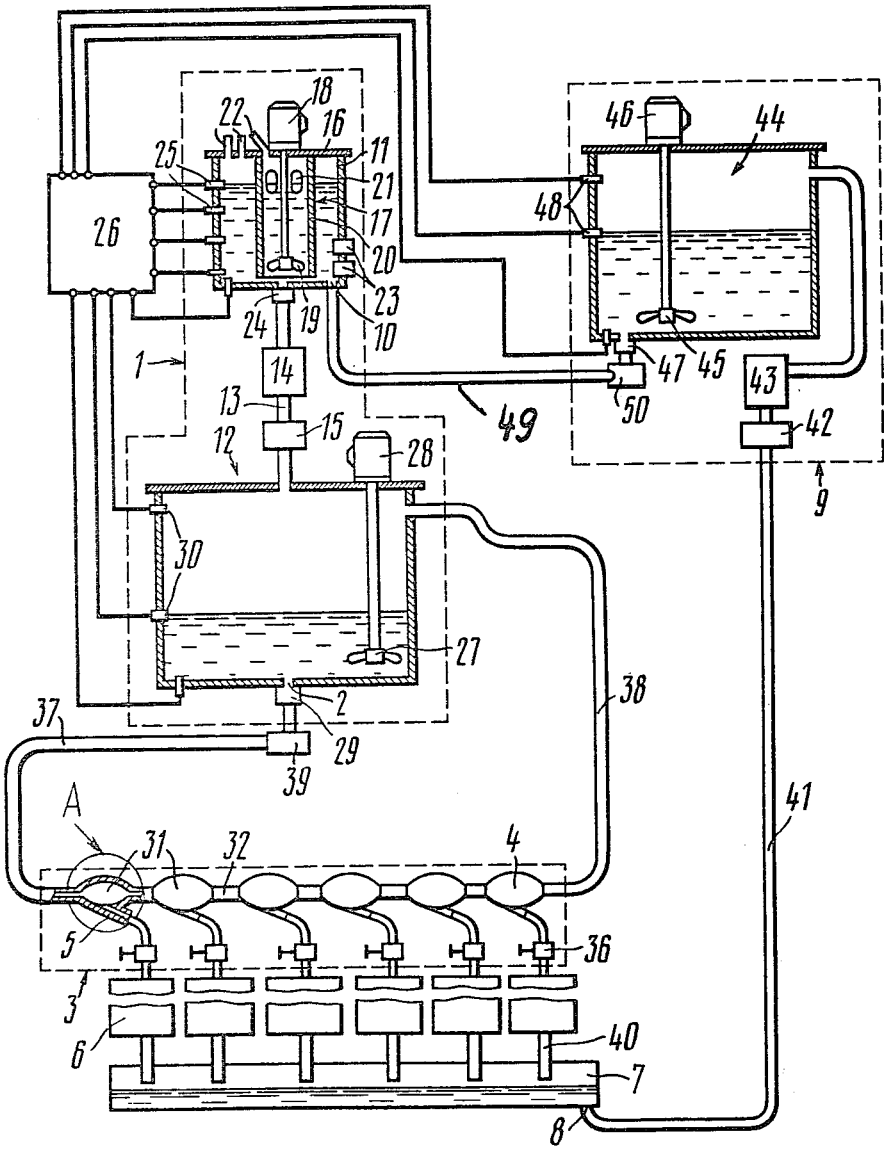
FIG. 1 is a schematic diagram of an apparatus for preparing and feeding an abrasive-containing suspension to work tools of polishing and finishing lathes.

The apparatus of the invention comprises a unit 1 for preparing a suspension from starting components, communicating through an outlet 2 with a distributing unit 3 formed with a pipe 4 having branch pipes 5 for feeding the suspension into the zone of action of work tools of polishing or finishing lathes 6. The polishing lathes 6 are connected to a reservoir 7 for collecting a waste suspension, communicating through its outlet 8 with a unit 9 for cleaning the waste suspension. The unit 9 for cleaning the waste suspension is connected in turn to an inlet opening 10 of the unit 1 for preparing the suspension. The unit 1 for preparing the suspension includes a reservoir 11 for preparing the suspension and a reservoir 12 for storing the prepared suspension. The reservoir 11 communicates with the reservoir 12 through a pipe 13. Inserted in the pipe 13 are a centrifuge 14 and a filter 15 intended for cleaning the suspension of coarse abrasive and other large-size foreign particles.

The reservoir 11 is a closed vessel with a lid 16, having a mixer 17 secured thereto.

The mixer 17 comprises an electric motor 18 carrying on its shaft and rigidly secured thereto a propeller stirrer 19, and a hollow cylinder 20 arranged coaxially with the axis of the stirrer 19 and it is provided with having perforations 21 in its walls.

In addition, the lid 16 of the mixer 17 is provided with connections 22 for feeding the starting components (water, abrasive, chemically active substances, for example, acids, alkalis) into the reservoir 11. Pickup elements 23 of a device for supervising the quality of the suspension are built into the wall of the reservoir 11.

What is meant by a device for supervising the quality of the suspension is, for example, a measuring device for determining the values of pH of solutions, or a device for determining the amount of the solid phase in a liquid and other similar devices (not shown).

Set in the bottom of the reservoir 11 is a cutoff valve 24 for controlling (blocking) the flow of the suspension from the reservoir 11 into the pipe 13. The amount of the suspension in the reservoir 11 is monitored by level pickups 25 electrically connected to a display 26.

Figure 2:
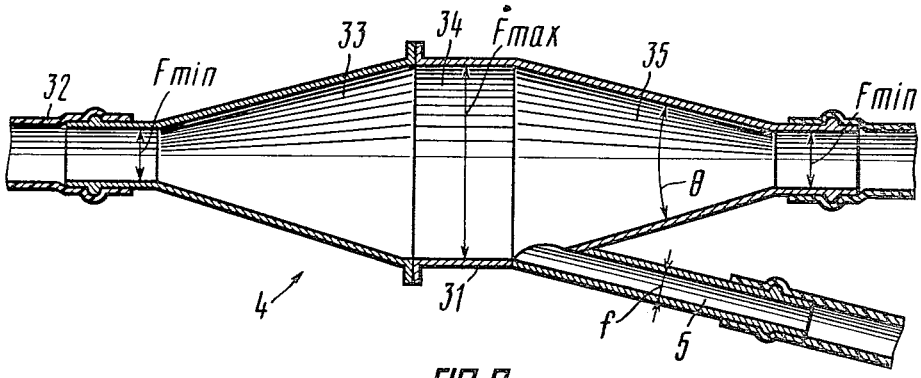
FIG. 2 is an enlarged fragmentary view of area A of FIG. 1.

The reservoir 12 is intended for storing the ready-to-use suspension and is provided with a mechanical stirrer 27 mounted on the shaft of an electric motor 28. Set in the bottom of the reservoir 12 is a cutoff valve 29 controlling the outlet 2 of the reservoir 12. The amount of the suspension in the reservoir 12 is monitored by level pickups 30, also electrically connected to the display 26. The distributing unit 3 comprises the pipe 4 of variable cross section and the branch pipes 5. The pipe 4 has sections 31 of greater cross section arranged at points of connection of the branch pipes 5 and cylindrical sections 32 of lesser cross section alternating with the sections 31. The sections 31 may be ellipsoidal in longitudinal section. However, a shape more easily manufactured is the one shown in FIG. 2, which illustrate the section 31 consisting of an expanding cone 33 (diffuser), a cylindrical portion 34 having a maximum cross section $F_{max}$ and a convergent cone 35 (contracting nozzle). The branch pipe 5 is placed near the cylindrical section 34 and its axis is set at an acute angle with respect to the axis of the pipe 4 in the direction of flow of the suspension. The cylindrical section 32 has a minimum cross section $F_{min}$. The geometric dimensions of these elements are selected as a function of the amount of suspension required by the lathe 6. Usually the area f of the cross section of the branch pipe 5 is taken somewhat greater than the calculated value to make possible regulation of the flow rate of the suspension. The value $F_{min}$ is selected so as to satisfy the inequality $F_{min} > n.f$, where n is the number of the branch pipes 5 connected to the lathes 6. The area of the maximum cross section $F_{max}$ is a function of the value of a local loss of head in the branch pipe 5. The optimum value is $$F_{max} = 3 \text{ to } 5\ F_{min}$$

This being the case, there appears a pressure (head) at the point of connection of the branch pipe, sufficient to overcome the local loss of head in the branch pipe 5. A further increase of $F_{max}$ leads to an unwarranted increase in the size of the unit. The angle $\theta$ of conicity can be selected within the range of 30° to 40°, thus minimizing stagnant zones lengthwise of the section 31 and ensuring a smoother flow of the suspension and better conditions for its offtake. The longitudinal dimension of the section 34 is selected to be not less than its diameter.

The flow rate of the suspension fed to the polishing lathe 6 (FIG. 1) can be regulated by valves 36 provided in the branch pipes 5. The best type of valves 36 are those that are operatively based on the principle of squeezing an elastic pipe.

The storage reservoir 12 and the distributing unit 3 communicate one with one another through pipes 37, 38 and form a closed circuit. A delivery pump 39 is set in the pipe 37. The lathes 6 are connected to the reservoir 7 for collecting the waste suspension via branch pipes 40. The reservoir 7 is coupled with the unit 9 for cleaning the suspension by means of a pipe 41 through the outlet opening 8. The cleaning unit 9 incorporates a filter 42 and a centrifuge 43 is set in the pipe 41 and a reservoir 44 receives the pipe 41. The reservoir 44 is provided with a mechanical stirrer 45 mounted on the shaft of an electric motor 46, and set in the bottom of the reservoir 44 is a cutoff valve 47. The amount of the suspension in the reservoir 44 is monitored by means of pickups 48, which are similar to the pickups 25, 30 in the reservoirs 11, 12 and they are also coupled to the display 26. The reservoir 44 of the cleaning unit 9 and the reservoir 11 of the unit 1 for preparing the suspension are interconnected by a pipe 49, wherein a delivery pump 50 is inserted.

The apparatus of the invention operates in the following manner.

To prepare the suspension, the starting components (water, chemically active substance, and an abrasive) are charged into the reservoir 11 of the unit for preparing the suspension through the sleeves 22. The volume of water is recorded by the pickups 25 which transmit a signal to the display 26. The amounts of the chemically active substances and of the abrasive (a fine powder, e.g. $SiO_2$ grains measuring 380 Å) are monitored by a pH-meter. As the abrasive is charged into the reservoir 11, it is mixed with the liquid in the mixer 17 where the propeller stirrer 19 is rotated by the electric motor 18. The stirrer 19 entrains the abrasive powder by inducing a flow of the liquid through the perforations 21, thoroughly mixes and ejects the suspension through the bottom open end of the hollow cylinder 20. The prepared and thoroughly mixed suspension passes, with the valve 24 open, along the pipe 13 to the centrifuge 14 where coarse abrasive particles and coagulated suspension are continuously drained to a sewer It is good practice to employ a horizontal-type centrifuge with a screw conveyor for discharging the settled matter. The suspension cleaned in the centrifuge 14 is fed to the cloth filter 15, where large hollow spheres of the abrasives are separated. The clean suspension flows into the reservoir 12 to be stored therein. As a specified level in the reservoir 12 is attained (as indicated by the signals of the pickups 30 on the display 26), the delivery pump 39 feeds the suspension, with the valve 29 open, to the distributing unit 3.

The reservoir 12 is equipped with the mechanical stirrer 27 actuated by the electric motor 28 to maintain the suspension in homogeneous state.

The suspension delivered by the pump 39 from the reservoir 12 into the distributing unit 3 enters the pipe 4 from where it is fed to the polishing lathes 6 via the branch pipes 5. The amount of the suspension fed to the lathes 6 is regulated by the valves 36. The excess suspension is returned from the pipe 4 into the reservoir 12 through the pipe 38.

A necessary condition for obtaining an excess amount of the suspension and for a normal operation of the apparatus is to maintain the velocity of flow of the suspension inside the pipe 38 several times greater than the critical velocity $V_c$, i.e. the velocity at which solids begin to settle. This velocity is a function of the diameter of the abrasive particles, the specific gravity of the suspension and the hydraulic size of the particles (by which is meant a set of characteristics of the particles which determines the velocity of their uniform fall in still water).

The conditions for drawing the suspension can be improved by making the pipe 4 of the distributing unit 3 variable in cross section, as this dwcreases the velocity of the flow in the sections 31 which are larger in cross section. The flow then becomes steadier and close in character to a laminar flow (with respect to fine grained $SiO_2$ powders). At the expanded sections 31, the local pressure increases to provide favorable conditions for drawing the suspension into the branch pipes 5. In the cylindrical sections 32 of the pipe 4 (the lengths of a lesser cross sectional area) the velocity of flow of the suspension increases, the flow becomes turbulent, the suspension is vigorously stirred to acquire homogeneity with respect to the solid phase, then passes onto the next section 31 of greater cross section, and so on. Thus, alternating falls and rises in the velocity of flow of the suspension, simultaneous with the changes of pressure, provide homogeneity of the suspension throughout the extent of the pipe and facilitate the withdrawal of the suspension to the lathes. In addition, the pressure in the pipe can be maintained by simpler means without any pressure stabilizers which cannot prevent the settling therein of the abrasive and the choking (plugging) of the pipe. This is achieved by providing artificially an increase in the local pressure at the expanded sections 31.

The branch pipes 5 for the suspension are set at an acute angle to the axis of the pipe 4 in the direction of flow of the suspension to lower the entry resistance into the branch pipes 5 and to keep vortical streams appearing at points of connection of the branch pipes 5 to a minimum and so minimize the setting of the abrasive and the chocking of the branch pipes 5.

During the operation of the polishing lathes 6, the suspension flows into the polishing zone from the branch pipes 5 through the regulating valves 36. After employment, the suspension flows along the pipes 40 into the reservoir 7 for collecting the waste suspension, and therefrom enters the filter 42 via the outlet opening 8 and the pipe 41. The filter 42, built of wire fabrics with meshes larger than 1 mm, pre-cleans the suspension of miscellaneous coarse objects, such as fragments of semiconductors slices, glass. From the filter 42, the suspension enters the centrifuge 43, similar to the centrifuge 14 mounted in the unit 1 for preparing the suspension.

In the centrifuge 43, mechanical waste from the polishing operation is separated from the suspension, and the clean suspension passes into the reservoir 44, where the suspension is collected to a specified level monitored by the pickups 46. The suspension is kept homogeneous by means of the stirrer 45 actuated by the electric motor 46. Once a specified level of the suspension is attained, the cutoff valve 47 is opened, and the suspension is fed by the delivery pump 50 into the reservoir 11 of the unit 1 for preparing the suspension along the pipe 49. As the suspension undergoes changes in the process of polishing, i.e. the amount of the abrasive therein decreases, the pH of the solution goes down as a result of the chemical attack of items being polished, a certain amount of the starting components is added to the suspension in the unit 1 for preparing the suspension to maintain their contents at specified levels. After a thorough mixing, the suspension is directed into the reservoir 12 for re-use, so that the waste suspension can be used several times in the process of polishing. The fitness of the suspension is checked in terms of the rate of polishing of items. Should the polishing rate fall below an acceptable level, the suspension is drained from the device, and another batch of the suspension is prepared from fresh starting components.

In addition, the apparatus of the invention makes it possible to effect the flushing of all the component elements according to the described cycle, the only difference being that water is fed into the apparatus instead of the suspension. As the reservoir 11 of the unit 1 for preparing the suspension can be flushed in the course of a shift during the intervals between cycles of preparation of the suspension with the aim of removing coagulated matter (coagulates, colloid formations and others) from the internal surfaces of the unit, no interruption in the operation of polishing lathes, and, therefore, of the processing cycle is considered necessary.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. An apparatus for preparing and feeding an abrasive-containing suspension into the zone of action of a plurality of tools of polishing or finishing lathes, comprising: a unit for preparing and storing the suspension having ports for charging starting components, and having an outlet opening and a plurality of inlet openings; connecting pipes; a distributing unit formed with a pipe of a longitudinally variable cross section with sections of greater and smaller cross sectional areas, and said distributing unit having an inlet opening and an outlet opening along the direction of flow of the suspension; said distributing unit communicating through the said connection pipes connecting said inlet opening with the outlet opening of the unit for preparing and storing the suspension and through the said outlet opening connecting with one of the said inlet opening of the unit for preparing and storing the suspension; branch pipes corresponding in number to said lathes and branching off from the said pipe of variable cross section at the place of said sections of greater cross section and directed toward the said zones of action of the work tools of the said lathes; a reservoir for collecting a waste suspension located beyond the zones of action of the work tools along the direction of flow of the suspension and having an outlet; and a unit for cleaning the waste suspension, having an inlet opening and an outlet opening and said cleaning unit communicating through other connection pipes connecting said inlet opening with the said outlet opening of the reservoir for collecting the waste suspension and through the said outlet opening connecting with another of the said inlet openings of said unit for preparing and storing suspension.

2. An apparatus as claimed in claim 1, wherein said maximum and minimum cross-sectional area of the pipe of said distributing unit are preferably selected so as to meet the following ratio:

$$F_{max}=3 \text{ to } 5 \text{ min},$$

where $F_{max}$, $F_{min}$ are respectively the maximum and the minimum cross sectional areas of the pipe of said distributing unit.

* * * * *